US010731806B2

(12) United States Patent
Bechter et al.

(10) Patent No.: US 10,731,806 B2
(45) Date of Patent: Aug. 4, 2020

(54) LIGHT STRIP SYSTEM WITH AN ELONGATE CARRIER RAIL

(71) Applicant: ZUMTOBEL LIGHTING GMBH, Dornbirn (AT)

(72) Inventors: Wolfgang Bechter, Hittisau (AT); Martin Bader, Dornbirn (AT); Wolfgang Gadner, Horbranz (AT)

(73) Assignee: ZUMTOBEL LIGHTING GMBH, Dornbirn (AT)

( * ) Notice: Subject to any disclaimer, the term of this patent is extended or adjusted under 35 U.S.C. 154(b) by 0 days.

(21) Appl. No.: 16/070,819

(22) PCT Filed: Jan. 26, 2017

(86) PCT No.: PCT/EP2017/051615
§ 371 (c)(1),
(2) Date: Jul. 18, 2018

(87) PCT Pub. No.: WO2017/137261
PCT Pub. Date: Aug. 17, 2017

(65) Prior Publication Data

US 2019/0032871 A1 Jan. 31, 2019

(30) Foreign Application Priority Data

Feb. 8, 2016 (DE) ..... 20 2016 100 613 U

(51) Int. Cl.
*F21S 8/02* (2006.01)
*F21S 4/28* (2016.01)
(Continued)

(52) U.S. Cl.
CPC ..... *F21S 4/28* (2016.01); *F21S 8/026* (2013.01); *F21V 21/025* (2013.01);
(Continued)

(58) Field of Classification Search
CPC ..... F21S 4/28; F21S 4/00; F21S 8/026; F21S 4/20; F21S 8/00; F21S 8/04; F21S 8/043;
(Continued)

(56) References Cited

U.S. PATENT DOCUMENTS 2,643,328 A * 6/1953 Elmendorf ..... B60Q 1/26 362/224
2,696,533 A 12/1954 Hammerly et al.
(Continued)

FOREIGN PATENT DOCUMENTS

AT 14268 7/2015
EP 2672172 12/2013
(Continued)

OTHER PUBLICATIONS

German search report dated Jul. 23, 2016 in priority German Patent Application 20 2016 100 613.9.
(Continued)

*Primary Examiner* — Isiaka O Akanbi
*Assistant Examiner* — Fatima N Farokhrooz
(74) *Attorney, Agent, or Firm* — Andrus Intellectual Property Law

(57) ABSTRACT

The invention relates to a strip light system, having an elongated carrier rail (1), which extends along a longitudinal axis (L) and has a U shape in a cross section normal to the longitudinal axis (L) as viewed in a first approximation, so that a first U leg (2), a second U leg (3) and a connecting leg (4), which connects the two U legs (2, 3) to one another, are formed, wherein at least one pass-through opening (5, 5') is formed in the connecting leg (4), and also having at least one luminaire, which is designed to be connected to the carrier rail (1), wherein at least one cover element (6), which is designed to be mounted on the carrier rail (1) so as to cover the at least one pass-through opening (5, 5'), is provided.

7 Claims, 4 Drawing Sheets

(51) Int. Cl.

| | |
|---|---|
| ***F21V 31/00*** | (2006.01) |
| ***F21V 21/02*** | (2006.01) |
| ***F21V 21/104*** | (2006.01) |
| *F21Y 103/00* | (2016.01) |

(52) U.S. Cl.
CPC ..... *F21V 21/104* (2013.01); *F21V 31/005* (2013.01); *F21Y 2103/00* (2013.01)

(58) Field of Classification Search
CPC ..... F21S 8/046; F21V 21/025; F21V 21/104; F21V 31/005; F21V 21/03; F21V 21/042; F21V 21/112; F21V 21/114; F21V 31/00; F21Y 2103/00
See application file for complete search history.

(56) References Cited

U.S. PATENT DOCUMENTS

| | | | | |
|---|---|---|---|---|
| 4,138,716 | A * | 2/1979 | Muhlethaler | F21S 8/06 362/260 |
| 5,743,625 | A * | 4/1998 | Tanner | F16L 3/13 362/216 |
| 6,220,721 | B1 * | 4/2001 | Chan | F21S 2/00 362/219 |
| 2003/0021116 | A1 * | 1/2003 | Miller | F24F 13/078 362/249.01 |
| 2005/0152132 | A1 * | 7/2005 | Bernhart | F21S 8/06 362/147 |
| 2007/0109795 | A1 | 5/2007 | Gabrius et al. | |
| 2009/0153077 | A1 * | 6/2009 | Noh | F21V 19/009 315/294 |
| 2011/0297971 | A1 * | 12/2011 | Shimizu | F21S 8/04 257/88 |
| 2012/0162974 | A1 | 6/2012 | Yu et al. | |
| 2013/0039052 | A1 * | 2/2013 | Forteza | F21V 19/00 362/223 |
| 2013/0170209 | A1 | 7/2013 | Lee et al. | |
| 2014/0003043 | A1 * | 1/2014 | Komiyama | F21S 8/037 362/184 |
| 2016/0069521 | A1 | 3/2016 | Ladstaetter | |
| 2016/0138769 | A1 * | 5/2016 | Hehle | F21V 23/02 362/296.01 |
| 2016/0281937 | A1 * | 9/2016 | Grigore | F21V 33/006 |
| 2017/0089553 | A1 * | 3/2017 | Ladstatter | F21V 27/00 |

FOREIGN PATENT DOCUMENTS

| | | |
|---|---|---|
| EP | 2944872 | 11/2015 |
| WO | 0040896 | 7/2000 |
| WO | 2014174019 | 10/2014 |

OTHER PUBLICATIONS

Austria search report dated Jul. 27, 2016 in co-pending Austria Patent Application GM 137/2016.
PCT search report dated Feb. 24, 2017 in parent PCT Patent Application PCT/EP2017-051615.

* cited by examiner

LIGHT STRIP SYSTEM WITH AN ELONGATE CARRIER RAIL

CROSS REFERENCE TO RELATED APPLICATIONS

The present application is the U.S. national stage application of International Application PCT/EP2017/051615 filed Jan. 26, 2017, which international application was published on Aug. 17, 2017 as International Publication WO 2017/137261 A1. The International Application claims priority to German Patent Application 20 2016 100 613.9 filed Feb. 8, 2016.

FIELD OF THE INVENTION

The invention relates to a strip light system with an elongated carrier rail and at least one luminaire, which is designed to be connected to the carrier rail.

BACKGROUND OF THE INVENTION

The applicant markets such a strip light system under the name "Slotlight Infinity". In this strip light system the carrier rail is formed by a profile element having a cross section that is substantially U-shaped. This carrier rail is aligned in such a way in order to operate that the two U legs point downwards. Inside the channel formed in this way, bar-shaped luminaires can be inserted from below. In this case the light is emitted downwards.

It has been found that it is not easily possible to achieve a higher class of protection with this strip light system. Although the underside can be readily sealed by means of a cover, through which the light is emitted, the top side of the carrier rail has some openings that are used to hold certain other components of the strip light system, as well as the pass-through of supply lines. Although those openings, which are not needed, can be basically closed by grommets, plugs or the like, such an approach is not practical.

The object of the present invention is to provide an improved strip light system. In particular, the strip light system should be easy to retrofit in such a way that it satisfies a higher class of protection.

This object is achieved, according to the invention, with the subject matter mentioned in the independent claim. Particular embodiments of the invention are disclosed in the dependent claims.

SUMMARY OF THE INVENTION

According to the invention, a strip light system is provided that has an elongated carrier rail, which extends along a longitudinal axis and which has a U-shape in a cross section normal to the longitudinal axis, when viewed in a first approximation, so that a first U leg, a second U leg and a connecting leg, which connects the two U legs to one another, are formed; and in this case at least one pass-through opening is formed in the connecting leg. Furthermore, the strip light system comprises at least one luminaire, which is designed to be connected to the carrier rail. In addition, the strip light system has at least one cover element, which is designed to be mounted on the carrier rail so as to cover the at least one pass-through opening.

An improved sealing of the strip light system can be achieved by means of the cover element. This aspect makes it possible to achieve, in particular, that the strip light system satisfies a higher class of protection, for example, an IP (ingress protection) protection class 40, according to which, in particular, protection against the intrusion of solid foreign bodies with a diameter greater than one millimeter is provided.

Preferably the pass-through opening is formed so as to be circular or oblong and is provided, in particular, for receiving a fastening element. Thus, the cover element is particularly suitable.

Preferably the cover element is designed as a profile member. This aspect is advantageous from a manufacturing point of view. In addition, this feature makes it possible to achieve a uniform outer visual appearance in a particularly suitable way.

Preferably a plurality of pass-through openings are formed in the connecting leg, where in this case the cover element is designed to be mounted on the carrier rail so as to cover the plurality of pass-through openings. This aspect makes it particularly easy to cover the plurality of pass-through openings.

Preferably the design is such that the cover element is held on the carrier rail by means of a latching connection. In this way it can be achieved that the cover element can be mounted on the carrier rail in a particularly easy-to-handle manner.

Preferably the cover element comprises two connecting regions, which are designed to be arranged so as to make contact with the carrier rail when the cover element is mounted, with the connecting regions being made of an elastic material. This aspect makes it possible to achieve a tight connection between the cover element and the carrier rail in a particularly suitable way.

Preferably the cover element has a ceiling region, which is designed to connect the two connecting regions to one another, with the ceiling region being made of a less elastic material. This aspect makes it possible to achieve, in particular, a suitably intrinsic rigidity of the cover element.

Preferably the cover element is designed as a two-component extruded profile. This aspect is advantageous from a manufacturing point of view.

Preferably the cover element is elongated, wherein the two corresponding end regions are designed in such a way that the cover element can be sealingly connected lengthwise to an additional cover element of the same construction. Thus, it can be achieved that two corresponding cover elements can be connected to one another at the front side or lengthwise in a suitably tight manner. Then the entire length of the carrier rail can be covered correspondingly by a corresponding number of such cover elements.

In this case the cover element has preferably a sealing lip on at least one of the two end regions. In this way a particularly suitable tightness can be achieved.

Preferably the at least one luminaire is designed to be inserted between the two U legs, in order to connect to the carrier rail. Thus, it can be achieved that, in particular, the carrier rail is suitably sealed off from the side opposite the connecting leg.

BRIEF DESCRIPTION OF THE DRAWINGS

The invention is explained in more detail below with reference to one exemplary embodiment and with reference to the drawings. The drawings show in.

DETAILED DESCRIPTION

Figure 2:
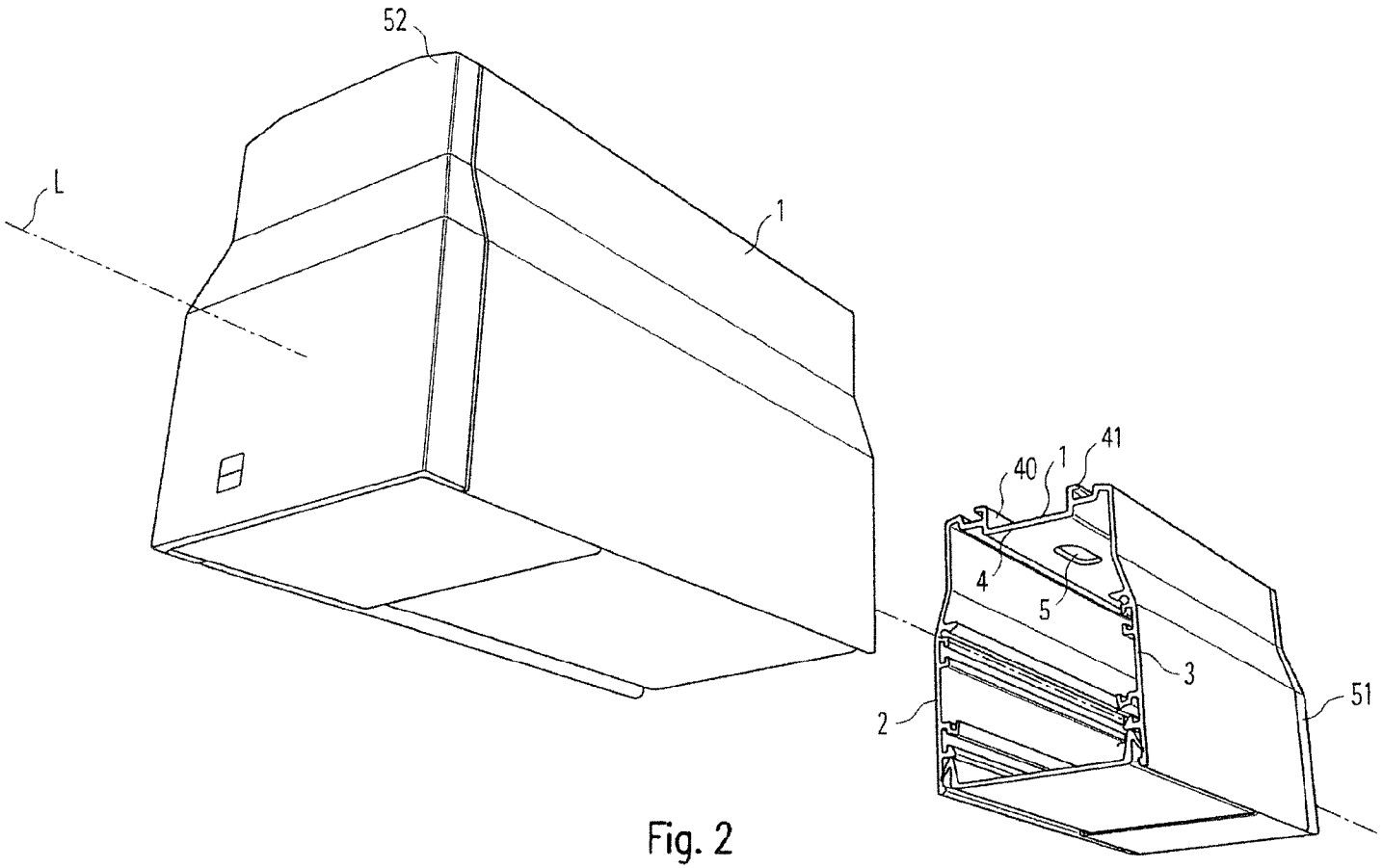
FIG. 2 is a perspective sketch of the carrier rail.
Figure 4:
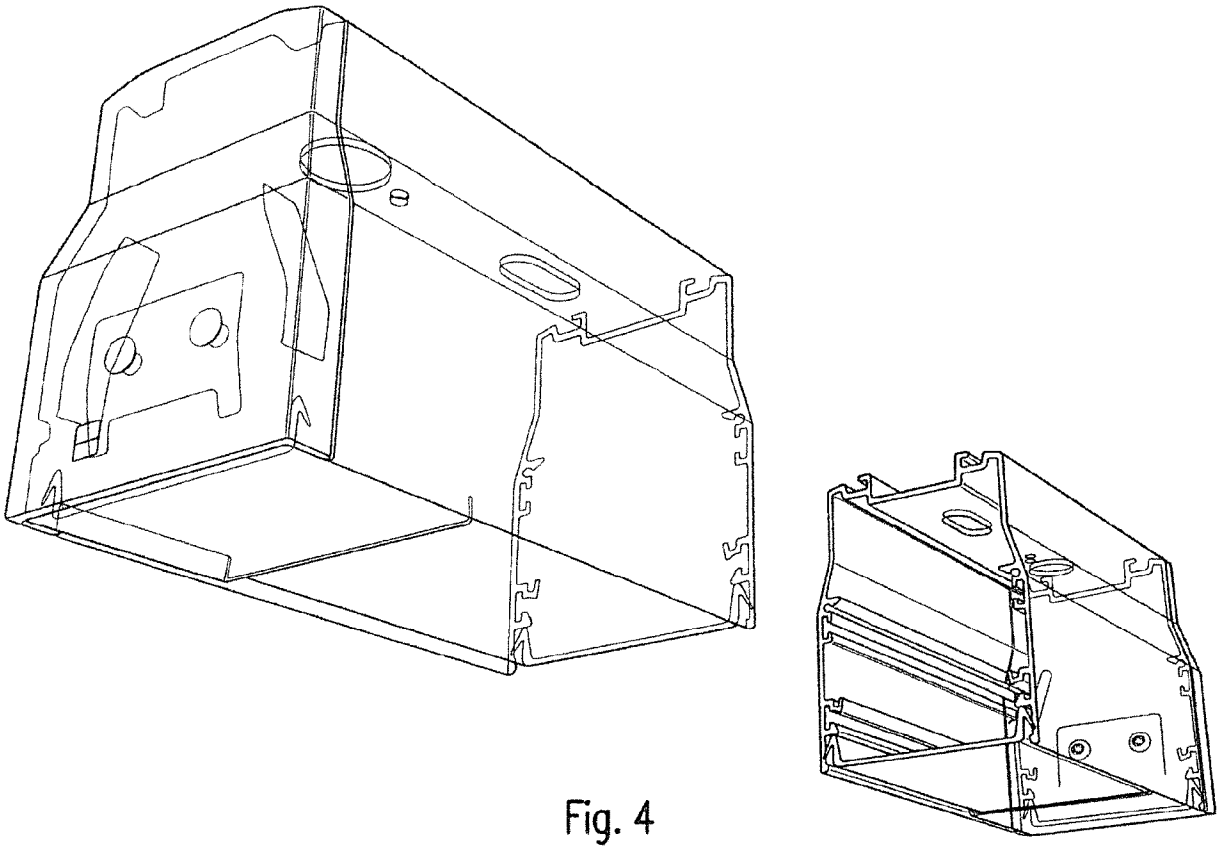
FIG. 4 is a representation, corresponding to that shown in FIG. 2, with partially transparent boundaries.

The invention relates to a strip light system with a carrier rail 1, as shown in perspective in sectional form in FIG. 2; FIG. 4 shows a representation, corresponding to that shown in FIG. 2, with partially transparent boundaries. The carrier rail 1 is elongated and extends along a longitudinal axis L. In particular, the carrier rail 1 may be designed as a profile element. Preferably the carrier rail 1 is made of a metal, for example, aluminum.

The carrier rail 1 has a U-shape in a cross section normal to the longitudinal axis L, when viewed in a first approximation, so that a first U leg 2, a second U leg 3 and a connecting leg 4, connecting the first U leg 2 to the second U leg 3, are formed. In particular, the carrier rail 1 is provided to be aligned in such a way in order to operate the strip light system that the first U leg 2 and the second U leg 3 point downwards, and the connecting leg 4 points upwards.

In particular, the connecting leg 4 may be designed so as to be structured, so that suitable engagement surfaces for fastening elements, for example, in the form of retaining clips are formed, by means of which the carrier rail 1 can be secured, for example, on a room ceiling. For example, it can be provided that the carrier rail 1 is attached to the ceiling as an add-on component or by means of suspension elements as a pendulum component.

Furthermore, the strip light system comprises at least one luminaire, which is designed to be connected to the carrier rail 1. In particular, the design may be such that the luminaire is inserted between the two U legs 2, 3, in order to connect to the carrier rail 1. Preferably the luminaire is designed to emit a light into the lower half-space, when said luminaire is connected, as intended, to the carrier rail 1.

In particular, it can be provided that the luminaire is elongated, but has a shorter length than the carrier rail 1. Special preference is given to the provision of a plurality of corresponding luminaires that can be connected lengthwise to the carrier rail 1 to form a series. In this way a long strip of light can be produced with the luminaires.

Preferably the carrier rail 1 is designed to receive electrical conductors in its inner region that is formed by the U-shape, where said electrical conductors are used to supply power to at least one luminaire. In addition, electrical contacting elements are provided that are also disposed in the inner region and that are used to transmit electric current between the electrical conductors and the at least one luminaire.

Figure 3:
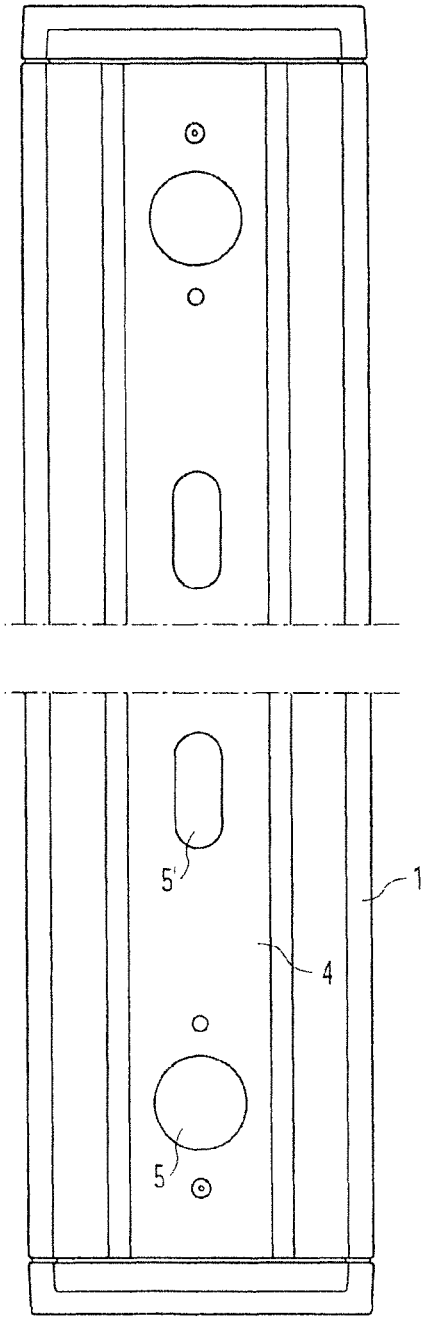
FIG. 3 is a view of the carrier rail from above.

A view of the carrier rail 1 is depicted from above in FIG. 3. At least one pass-through opening 5 is formed in the connecting leg 4; and said pass-through opening is used, in particular, to hold certain components, such as, for example, the aforementioned contacting elements or a pass-through of an electrical supply line. Consequently preferably a plurality of pass-through openings 5, 5' are formed in the connecting leg 4.

For example, the at least one pass-through opening 5 may be circular or oblong; in particular, it can be used to receive a fastening element, for example, a screw 7, for fastening a corresponding component.

Figure 1:
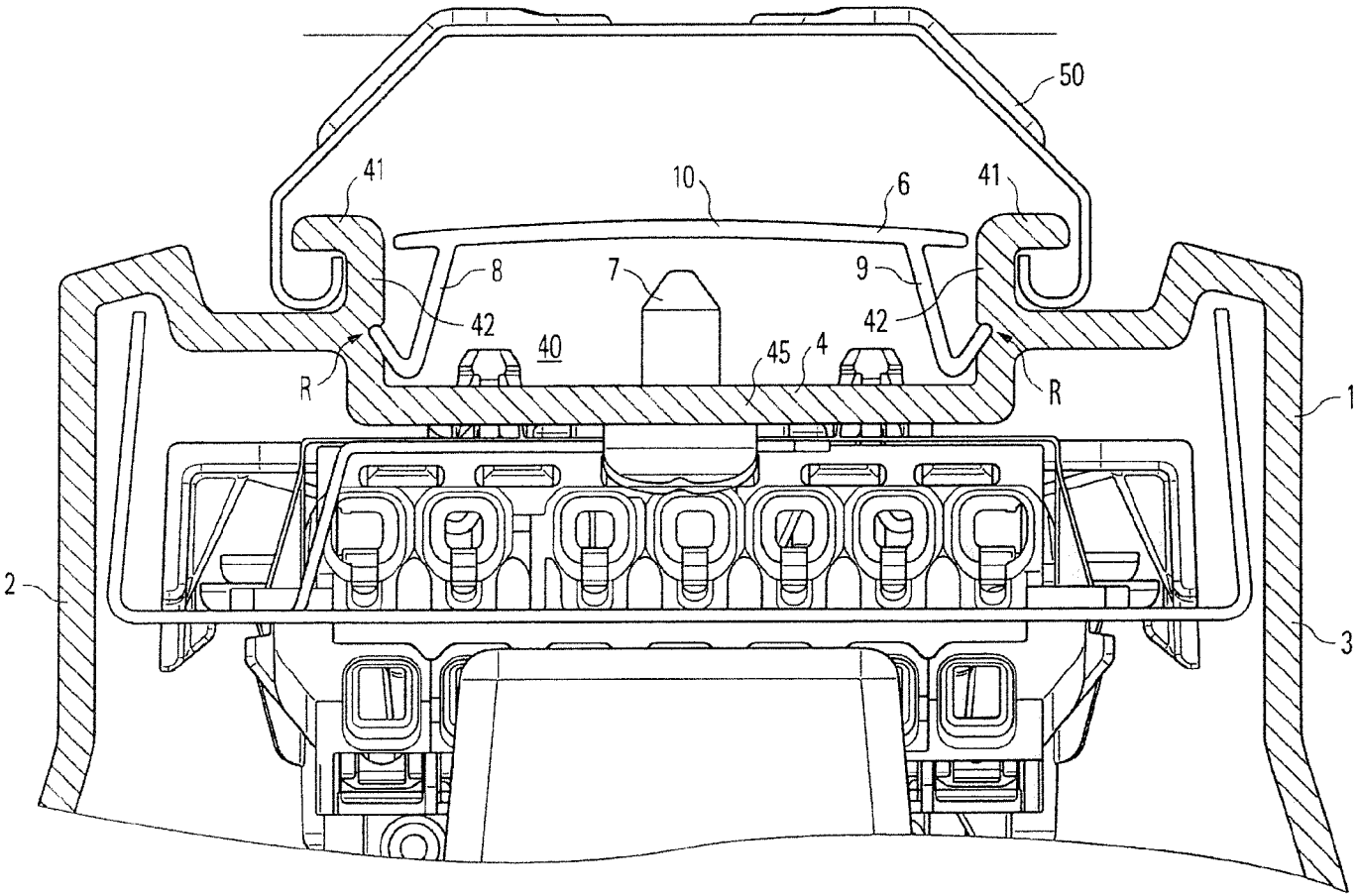
FIG. 1 is a detail of a cross section normal to the longitudinal axis of the carrier rail in a strip light system according to the invention.

A detail of a cross section normal to the longitudinal axis L of the carrier rail 1 is depicted in FIG. 1. As can be seen from this figure, the strip light system also comprises a cover element 6, which is designed to be mounted on the carrier rail 1 so as to cover the at least one pass-through opening 5, 5'. This aspect has the advantage that the at least one pass-through opening 5,5' is covered, so that intrusion of a foreign body into the inner region of the carrier rail 1 is rendered more difficult. This aspect is particularly advantageous, if a plurality of pass-through openings 5, 5' are formed in the connecting leg 4 and not all of these pass-through openings 5, 5' are occupied by corresponding fastening elements or supply lines and, as a result, are more or less closed.

For example, it can be achieved with the cover element 6 that the IP protection class 40 is achieved.

Preferably the cover element 6 is designed as a profile member, in particular, in such a way that it can be connected to the carrier rail so as to be oriented with its corresponding profile axis parallel to the longitudinal axis L of the carrier rail 1. In this case the design is preferably such that the cover element 6 is so long that it covers at least two of the plurality of pass-through openings 5,5'.

Advantageously there are provided a plurality of corresponding cover elements or cover elements of identical construction that can be mounted on the carrier rail 1 so as to form a series along the longitudinal axis L, so that consequently the carrier rail 1 is covered along its entire longitudinal extent. This aspect makes it possible to achieve a particularly suitable protection.

Preferably the design is such that the cover element 6 is held on the carrier rail 1 by means of a latching connection R. This aspect makes it possible to achieve that the cover element 6 can be mounted on the carrier rail 1 in a particularly simple or easy-to-handle manner, for example, without the aid of a tool. By means of the latching connection R, it is possible to achieve that the cover element 6 can be mounted on the carrier rail 1, which is configured in such a way as to be already ready for use. Therefore, the cover element 6 is suitable as a "retrofit part," by means of which a desired higher class of protection can be subsequently achieved.

In the example shown, the cover element 6 comprises two connecting regions 8, 9, which are designed to be arranged so as to make contact with the carrier rail 1 when the cover element 6 is mounted, with the connecting regions 8, 9 being made of an elastic material. Thus, a particularly suitable tightness between the cover element 6 and the carrier rail 1 can be achieved. The connecting regions 8, 9 can be designed as profile-like arm regions, which extend accordingly along the profile axis or in the assembled state along the longitudinal axis L.

By means of the latching connection R, it is also possible to achieve that the cover element 6 can be mounted on the carrier rail 1, which is configured in such a way as to be already ready for use. Therefore, the cover element 6 is suitable as a "retrofit part", by means of which a desired higher class of protection can be subsequently achieved.

As in the case in the example shown, the cover element 6 may also have a ceiling region 10, which is designed to connect the two connecting regions 8, 9 to one another, with the ceiling region 10 being made of a less elastic material. Thus, the cover element 6 can be designed both with a suitable intrinsic stability and with advantageous latching connection properties. In this case, for example, a two-component extrusion process is suitable for manufacturing the cover element 6 for reasons of expediency. The ceiling region 10 may be designed planar or plate-shaped, in particular, in a first approximation.

In the example shown, the connecting leg 4 has a profiled structure, by means of which an upwardly open recess 40 is formed, which has a floor region 45, as well as two lateral boundary regions 42, where in this case the at least one pass-through opening 5,5' is formed in the floor region 45. In this respect the cover element 6 is designed preferably in such a way that the recess 40 is concealed or covered, as depicted by way of example in FIG. 1.

In the example shown, the profiled structure of the connecting leg 4 is further designed in such a way that two holding regions 41 are formed that serve as engagement surfaces for at least one retaining clip 50, which is provided, for example, for fastening the carrier rail 1 to a room ceiling or for connecting to a cable or any other suspension element for a suspended attachment of the carrier rail 1. In the example shown, the two holding regions 41 are designed advantageously as portions of the two lateral boundary regions 42 of the recess 40.

In the example shown, the two lateral boundary regions 42 of the recess 40 have in each case an elongated groove, where in this respect the two grooves that are formed in this way are designed for receiving the two connecting regions 8, 9. In this case it is particularly advantageous that the connecting regions 8, 9 can be designed so as to be curved in such a way that they engage in the grooves when the cover element 6 is mounted on the carrier rail 1, so that in this way the aforementioned latching connection, by means of which the cover element 6 is held on the carrier rail 1, is produced.

As apparent from FIG. 1, the design can be advantageous in such a way that between the floor region 45 of the recess 40 and the ceiling region 10 of the cover element 6 a vertical distance is formed that is, for example, about as large as the height of the two lateral boundary regions 42. In this way it can be achieved that a fastening element, engaging in the pass-through opening 5, is also covered by the cover element 4.

As already briefly mentioned, corresponding cover elements can be mounted over the entire longitudinal extent of the carrier rail 1, while being arranged end to end against each other. In order to bring the length of the cover elements into conformity with the length of the carrier rail 1, one of the cover elements can be shortened accordingly, as required.

Correspondingly designed end caps 51, 52 may be provided to lock the cover elements, when viewed along the longitudinal axis L, so that they can no longer move parallel to the longitudinal axis L. The end caps 50, 51 can be designed, as depicted in FIG. 2, in such a way that they also seal the inner region of the carrier rail 1 accordingly.

Preferably the cover element 6 is elongated, where in this case the two corresponding end regions are designed in such a way that the cover element 6 can be sealingly connected lengthwise to an additional cover element of the same construction. Thus, a suitable tightness can also be achieved at the long-sided end regions of the cover element. For this purpose, the cover element 6 can have, for example, a sealing lip on at least one of the two end regions. The design may also be such that an end-sided engagement is made possible so that two adjacent cover elements can be arranged in such a way as to slightly overlap.

Preferably the cover element 6 is elongated, where in this case the two corresponding end regions are designed in such a way that the cover element 6 can be sealingly connected lengthwise to an additional cover element of the same construction. Thus, a suitable tightness can also be achieved at the long-sided end regions of the cover element. For this purpose, the cover element 6 can have, for example, a sealing lip on at least one of the two end regions. The design may also be such that an end-sided engagement is made possible so that two adjacent cover elements can be arranged in such a way as to slightly overlap.

In order to enable an electrical in-feed, which runs from the outside into the inner region of the carrier rail 1, it can be provided that the cover element 6 can be provided or is provided with a corresponding pass-through hole, through which a corresponding supply line can be run. In this case, for example, a grommet, which corresponds to the desired class of protection, can be provided for sealing purposes.

What is claimed is:

1. A retrofittable strip light system, comprising an elongated carrier rail (1), which extends along a longitudinal axis (L) and which has a U-shape in a cross section normal to the longitudinal axis (L), when viewed in a first approximation, so that a first U leg (2), a second U leg (3) and a connecting leg (4), which connects the two U legs (2, 3) to one another, are formed; wherein at least one pass-through opening (5, 5') is formed in the connecting leg (4), the elongated carrier rail (1) further includes an elongated, upward facing recess extending the entire longitudinal extent of the carrier rail with the connecting leg (4) forming a recess floor and upstanding walls forming lateral boundaries of the elongated, upward facing recess, and an elongated groove is formed in each lateral wall of the recess, wherein a holding region extends from a top of each of the upstanding walls forming the lateral boundaries of the elongated, upward facing recess;

at least one luminaire connected to the carrier rail (1) below the connecting leg (4);

one or more elongated cover elements (6) configured to be mounted on the carrier rail (1) so as to cover the at least one pass-through opening (5, 5'), wherein the one or more cover elements (6) each comprise two connecting regions (8, 9) made of an elastic material and adapted to engage in the elongated groove on each respective upstanding wall forming the lateral boundaries of the upward facing recess on the carrier rail (1), and a ceiling region (10) made of a less elastic material that connects the two connecting regions (8, 9) to one another, and further, when the one or more cover elements (6) are mounted to the carrier rail (1), the one or more cover elements (6) form latching connections (R) with the elongated grooves in the upstanding walls of the elongated, upward facing recess so that the one or more cover elements cover the elongated, upward facing recess along its entire longitudinal extent, and further wherein the cover is selectively mounted on the carrier rail to retrofit the strip light system so that it satisfies IP class 40 standards;

a first end cap connected to a first end of the elongated carrier rail and a second end cap connected to a second end of the elongated carrier rail, wherein the first and second end caps together with the one or more cover elements seal the elongated, upward facing recess of the carrier rail (1) along its entire longitudinal extent; and a retaining clip that engages the holding regions for suspending the carrier rail from a ceiling or suspension device.

2. The strip light system, as claimed in claim 1, wherein the pass-through opening (5, 5') is formed so as to be circular or oblong and is provided, in particular, for receiving a fastening element (7).

3. Strip light system, as claimed in claim 1, wherein the cover element (6) is designed as a profile member.

4. The strip light system, as claimed in claim 1, wherein a plurality of pass-through openings (5, 5') are formed in the connecting leg (4), wherein the cover element (6) is designed to be mounted on the carrier rail (1) so as to cover the plurality of pass-through openings (5, 5').

5. The strip light system, as claimed in claim 1, wherein the cover element (6) is a two-component extruded profile.

6. The strip light system, as claimed in claim 1, comprising two or more elongated cover elements (6) arranged adjacently end to end to cover the upward facing recess on the carrier rail.

7. The strip light system, as claimed in claim 1, wherein the at least one luminaire is designed to be inserted between the two U legs (2, 3), in order to connect to the carrier rail (1).

* * * * *